United States Patent [19]

Suzuki et al.

[11] 4,365,426

[45] Dec. 28, 1982

[54] HAIR DRYER

[75] Inventors: Kunio Suzuki; Minoru Takahashi, both of Kyoto, Japan

[73] Assignee: Hitachi, Ltd., Tokyo, Japan

[21] Appl. No.: 223,290

[22] Filed: Jan. 8, 1981

[30] Foreign Application Priority Data

Jan. 11, 1980 [JP] Japan ..... 55/1292

[51] Int. Cl.[3] ..... F26B 11/00; A45D 2/36

[52] U.S. Cl. ..... 34/101; 34/97; 34/68; 132/9; 132/11 R; 219/222; 219/373

[58] Field of Search ..... 132/7, 9, 11, 33 R; 219/222, 225, 226, 373; 34/96, 97, 101

[56] References Cited

U.S. PATENT DOCUMENTS 4,214,149 7/1980 Hoffmann ..... 34/97

FOREIGN PATENT DOCUMENTS 52-43548 4/1977 Japan ..... 132/9
54-36862 3/1979 Japan ..... 219/222
2002630 2/1979 United Kingdom ..... 219/222
2022406 12/1979 United Kingdom ..... 219/222

*Primary Examiner*—Larry I. Schwartz
*Attorney, Agent, or Firm*—Antonelli, Terry & Wands

[57] ABSTRACT

A hair drier having a casing provided at its end with a discharge port through which hot air is discharged, a heating bar provided at the center of the discharge port and extending forwardly from the casing, and a hair setting member provided with a deep insertion hole for receiving the heating bar.

8 Claims, 6 Drawing Figures

1
2
3
4
5
6
7
8
9
10
11
12
13
14
15
16
17
18
19
19A
20
20
$D_2$
$L_1$
$\frac{1}{2}L_1$
$\frac{1}{2}L_1$
$L_1$
d 21
22
23
25
26
27
$b_1$
$b_2$

III
III
21
22
22A
23
24
25
28
29
30
31
32
33
34
$D_1$
$L_2$
$L_3$

HAIR DRYER

BACKGROUND OF THE INVENTION

The present invention relates to a hair dryer having a hair setting instrument for promoting the curling of hair by a forcible heating of the hair.

The following types of hair dryer are known as the hair dryer of the kind mentioned above.

Namely, a first type hair dryer is adapted to blow hot air against the hair wound round a hair setting member, while a second type drier is adapted to heat the hair setting member round which the hair is wound thereby to heat the hair by the heat conduction through the hair setting member.

The hair dryer of the first type mentioned above, however, has a drawback in that the inner portion of the hair adjacent to the hair setting member can hardly be curled because the hot air is blown against the outer portion of the hair.

To the contrary, in the hair dryer of the second type, the portion of the hair near the outer side can hardly be curled because the heating is made from the inside.

Thus, with these known hair dryers, it is not possible to obtain uniform curling of the hair. If the heating time is elongated for achieving a complete curling, the hair is locally heated excessively to be damaged seriously.

SUMMARY OF THE INVENTION

It is, therefore, a major object of the invention to provide a hair dryer which permits the hair to be curled uniformly in a short heating time, while avoiding damaging of hair.

To this end, according to the invention, there is provided a hair dryer comprising a casing and a hair setting member detachably secured to the casing, the casing being provided at its end with a hot air discharge opening at the center of which provided is a heating bar projecting forwardly from the casing, the heating bar being received by a deep hole formed in the hair setting member.

BRIEF DESCRIPTION OF THE DRAWINGS

The accompanying drawings show an embodiment of the invention in which.

DETAILED DESCRIPTION OF THE PREFERRED EMBODIMENT

Figure 1:
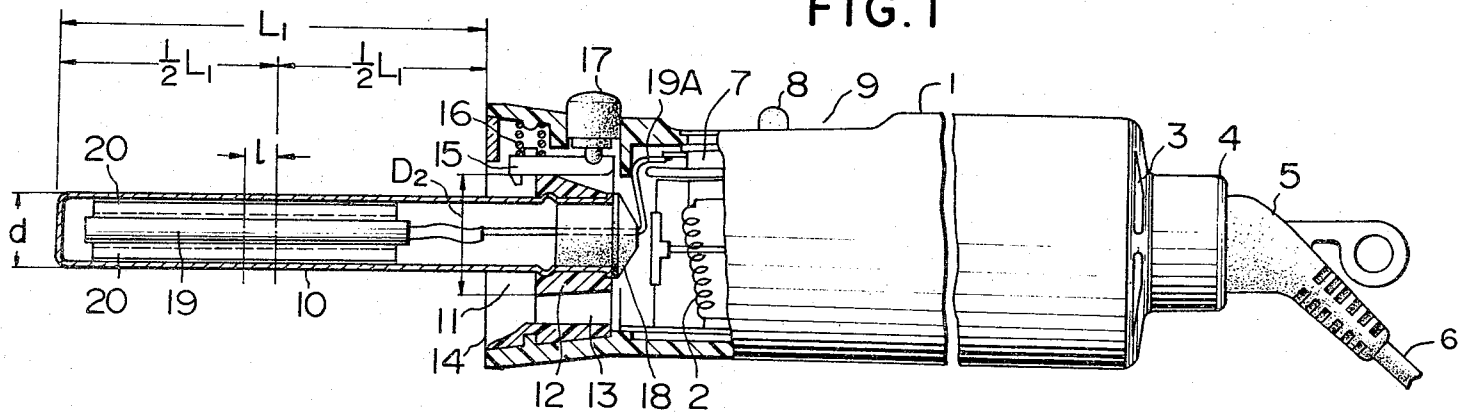
FIG. 1 shows a casing of a hair dryer with its essential part sectioned.

A casing 1, forming a major part of the hair dryer is a substantially cylindrical body with an internal cavity. This casing 1 is of a split type consisting of two halves, each having a semicircular cross-section, combined with each other. The casing 1 has a length of about 170 mm and a diameter of about 40 mm so that it can be gripped by hand easily. The cylindrical shape of the casing 1, however, is not exclusive and the casing 1 can have various other shapes if such shapes are suitable for gripping by hand.

Heating means, including a nichrome wire 2, and blowing means, including a fan motor, are mounted in the casing 1. The casing 1 is provided at its rear portion with an air intake port 3 for taking air into the casing 1. A rotary plug support 4 is provided at the center of the intake port 3. A rotary plug 5 is supported by the support 4. A power supply cord 6 extends through the rotary plug 5 and is connected to the nichrome wire 2, fan motor and so forth.

It will be seen that, thanks to the provision of the rotary plug 5, the power supply cord is never twisted even if the casing 1 is rotated.

A change-over switch 7 is provided at the front side of the longitudinal center of the casing 1. The manipulation button 8 of this switch is projected from the outer peripheral surface of the casing 1, but the amount of projection is small because the button 8 is situated in a recess 9 formed in the outer peripheral surface of the casing 1. Therefore, the erroneous or accidental operation due to a touching of the switch 7 with something is fairly avoided.

The following description has a specific relevancy to the present invention.

A heating bar support 11 for supporting a heating bar 10 is secured to the front side of the casing 1. The heating bar support 11 is made of a plastic material and is provided at its central portion with a support portion 12. A plurality of ventilation ports 13 are formed around the support portion 12, whereas, a discharge port 14 is formed at the front side of the support portion 12.

Also, at the front side of the casing 1, provided is a hook 15 for retaining a hair setting member which will be explained later. The hook 15 is movable around a fulcrum constituted by the peripheral portion of the support portion 12. The hook 15 is provided with a spring 16 for energizing the retaining of the hair setting member. A push button 17 for releasing the hair setting member is provided so as to project from the outer peripheral surface of the case 1.

The heating bar 10 is formed of a metal having a high heat conductivity, and has an internal cavity, and is open at its front end but is closed at the rear end. The heating bar 10 is attached by fitting its rear end to an attaching hole formed in the aforementioned support portion 12. An insulating bush 18 is press-fitted into the rear end opening of the heating bar 10. The insulating bush 18 has a conical- shaped head exposed into the casing 1, so that air can flow smoothly from the inside of the casing 1 toward the ventilation ports 13.

The heating bar 10 thus attached is projected by a length $L_1$ of 72 mm from the front end of the casing 1, and has a diameter d of 12 mm.

A heat generating body 19 having a length of 54 mm is attached to the inside of the heating bar 10. The heat generating body 19 is made of a resistance element having a positive temperature coefficient. This heat generating body 19 is offset from the center of the heating bar 10 forwardly by a distance l of 5 mm, for a reason which will be detailed later.

The heat generating body 19 is clamped between a pair of heat radiating plates 20 each having a semi-circular cross-section, and is securely mounted in the heating bar 10. Since the heat radiating plate 20 is made of a material having a good heat conductivity, the heat generated by the heat generating member plates 20 is promptly transmitted to the heating bar 10.

Lead wires 19A of the heat generating body 19 are connected to the change-over switch 7 through a central through bore of the insulating bush 18.

Figure 3:
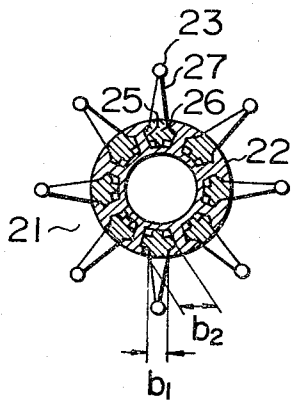
FIG. 3 is a sectional view taken along the line III—III of FIG. 2.
Figure 2:
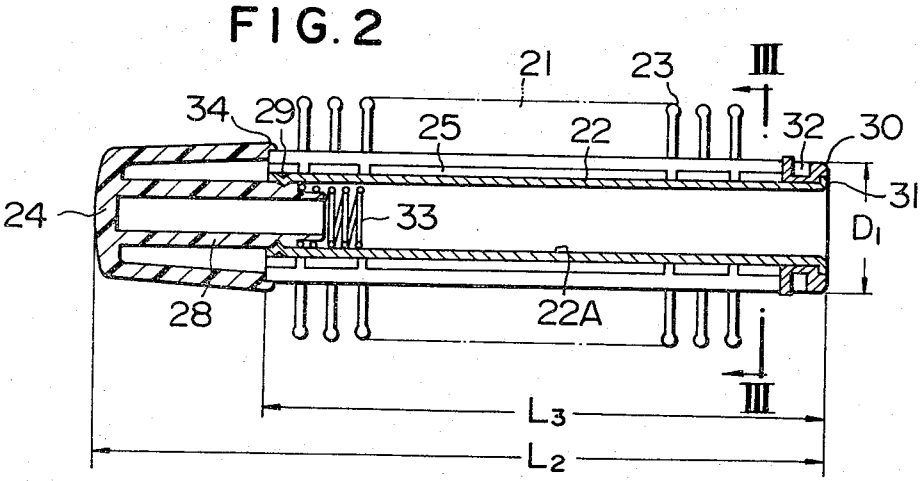
FIG. 2 is a sectional view of a hair setting member.

The hair setting member is so constructed as to be detachably secured to the heating bar 10, as shown in FIGS. 2 and 3.

The hair setting member 21 is constituted mainly by a tubular base 22, a brush piece 23 and a knob 24.

The tubular base 22 is made of a metal having a high heat conductivity, such as aluminum. At the center of the tubular base 22 is formed a deep axial insertion hole 22A having an inside diameter slightly greater than the outside diameter of the heating bar 10, so that the hair setting member 21 can be fitted to the heating bar 10 and, in addition, since the outer peripheral surface of the heating bar 10 makes a uniform contact with the outer peripheral surface of the heating bar 10 without substantial gap therebetween, heat is transmitted promptly and uniformly over the entire surface of the heating bar 10.

The tubular base 22 has an outside diameter $D_1$ of 22 mm which approximates the outside diameter $D_2$ of the support portion 12. Therefore, in the state that the hair setting member 21 is secured to the heating bar 10, the ventilation ports 13 are never closed by the rear end of the tubular base 22, so that the flow of air from the ventilation ports 13 is never hindered.

The hair setting member 21 has a length $L_2$ of 122 mm, while the tubular base 22 has a length $L_3$ of 93 mm.

The outer peripheral surface of the tubular base 22 is provided with a longitudinally extending support groove 25 for securing the brush piece 23. As will be seen from FIG. 3, the support groove 25 has such a cross-section that the size $b_1$ at the inlet side is wider than the size $b_2$ at the inner side.

Figure 6:
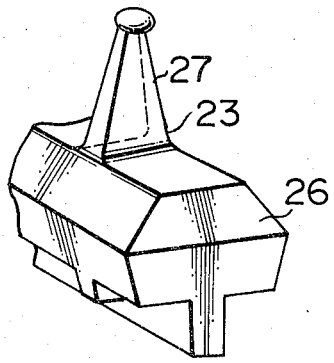
FIG. 6 is a perspective view of a brush piece.

As shown in FIG. 6, the brush piece 23 attached to the support groove 25 has an elongated base 26 and a plurality of projections 27 for winding the hair. The brush piece 23 is made of a heat resistant plastic of polyester group.

The base portion 26 of the brush piece 23 has a cross-section conforming that of the support groove 25, so that the brush piece 23 can be securely attached to the tubular base 22 as its base portion 26 is inserted into the support groove 25. Namely, since the support groove 25 has wider inner portion and the narrower outer portion, the base portion 26 can never be withdrawn from the support groove 25, however the brush piece 23 may be pulled radially outwardly. The secure attaching is especially important because the brush piece 23 makes a slight shrinkage when cooled.

The attaching of the brush piece 23 by means of a screw or the like is not preferred because of entanglement of the hair, so that the attaching construction of the described embodiment is desirable.

The brush piece 23 is prevented from being dropped off from the support groove in the longitudinal direction in the following manner.

Namely, the knob 24 is provided at its inner side with an attaching boss 28. After fitting the attaching boss 28 to the front side of the tubular base 22, the latter is pressed such that a depression 29 is formed at the bottom of the support groove 25, so that the inner peripheral portion of the tubular base 22 is pressed into the attaching boss 28. By this arrangement, the knob 24 is securely attached to the tubular base 22.

The above-explained attaching of the knob 24 is made before the attaching of the brush piece 23 to the tubular base 22. Alternatively, the knob 24 may be secured to the tubular base 22 after the attaching of the brushpiece 23 by bonding the attaching boss 28 of the knob 24 to the tubular base 22 by an adhesive.

After the attaching of the knob 24, the front end surface of the brush piece 23 is in contact with the knob 24, so that the brush piece 23 cannot be withdrawn in the forward direction from the tubular base 22.

A stopper ring 30 is secured to the outer peripheral surface of rear part of the tubular base 22, while a retainer 31 is formed by slightly bending the rear end of the tubular base 22, so that the stopper ring 30 is fixed. Since the brush piece 23 makes a contact at its rear end surface with the stopper ring 30, it can never be withdrawn in the rearward direction.

As will be understood from the foregoing description, the brush piece 23 is clamped at its front and rear sides by the knob 24 and the stopper ring 30, so that the brush piece 23 can neither be withdrawn in the forward nor rearward direction.

A hook retainer hole 32 is formed in the outer periphery of the stopper ring 30. The hair setting member 21, attached to the heating bar 10, is stopped by making the aforementioned hook 15 be engaged by the hook retainer hole 32. Thus, the hair setting member 21 can be detached from the heating bar 10 by disengaging the hook 15 from the hook retainer hole 32. Also, the hook retainer hole 32 is not of an annular form but only of partial annular form, and the hair setting member 21, attached to the heating bar 10, is prevented from being rotated, as the hook 15 engages with the hook retainer hole 32.

A spiral spring 33 is secured to the attaching boss 28 of the knob 24. As the hair setting member 21 is inserted into the hair setting member 21, the spring 31 is brought into contact with the end of the heating bar 10. Then, as the hair setting member 21 is further pushed overcoming the force of the spring 33, the hook 15 is engaged by the hook retainer hole 32, so that the hair setting member 21 is fixed in relation to the casing 1. As the push button 17 is depressed, the hook 15 is disengaged from the retainer hole 32 so that the hair setting member 21 is automatically moved outwardly by the force of the spring 33. If the spring 33 has a large spring constant, the hair setting member 21 will dangerously spring out of the heating bar 10. Therefore, it is preferred not to use a spring having a large spring constant, as the spring 33.

The brush piece 23 attached to the tubular base 22 is formed such that the base portion 26 thereof is flush with the outer peripheral surface of the tubular base 22. A tubular projection 34 is formed on the outer periphery of rear part of the knob 24 so as to overlap the outer periphery of front part of the tubular base 22. This overlapping construction is adopted to avoid undesirable catching of the hair wound on the hair setting member 21. It will be seen that, without the tubular extension 34, the hair will be caught in the gap formed between the front end surface of the tubular base 22 and the abutting end of the knob 24. However, the above-mentioned overlapping construction effectively prevents the catching of the hair, even when a gap is formed between the tubular projection 34 and the outer periphery of the tubular base 22, because this gap extends at a right angle to the direction of winding of the hair. The catching of the hair is undesirable not only because it imparts a feel of pain to the user but also it disturbs the curl of hair formed by the hair dryer.

Although the above-explained overlapping construction is not adopted at the rear end side of the hair setting member 21, the catching of the hair does not occur at the rear side. Namely, as the hair setting member 21 is secured to the heating bar 10, the hair setting member 21 is brought into such a state that the rear end of the main body case 1 is fitted in the discharge port 14 at the front side of the casing 1. Namely, the gap at the joint surface between the stopper ring 30 and the rear end of the brush piece 23 is located inwardly from the front end of the casing 1. The gap, therefore, does not catch the hair.

It is, however, preferred to adopt the aforementioned overlapping construction also at the rear side, if the arrangement is not such that the rear end of the hair setting member 21 comes to face the discharge port 14 of the front side of the casing 1.

Hereinafter, a description will be made as to the electric circuit incorporated in the hair dryer having the described construction.

The change-over switch 7 includes a heating circuit switch 7A for opening and closing the circuit for the nichrome wire 2 and the heat generating body 19, and a motor circuit switch 7B for opening and closing the fan motor (blower means) 35. The nichrome wire 2 and the heat generating body 19 are connected in parallel with each other. This parallel circuit is connected to an A.C. power supply through the heating circuit switch 7A, thermostat 36 and a thermal fuse 37.

The rectifier circuit 38 of the fan motor 35 is connected to the A.C. power supply through the motor circuit switch 7B, resistance 39 for dropping voltage and the thermal fuse 37.

In the operation of the hair dryer having the above-described mechanical and electrical constructions, as the change-over switch 7 is operated to close the heating circuit switch 7A and the motor circuit switch 7B to the positions $S'_3$ and $S_3$, respectively, the hair setting member 21 is heated from its inner side. Simultaneously, as the nichrome wire 2 generates heat, the air blown by the fan motor 35 is heated and is discharged as hot air from the discharge port 14. This hot air flows around the hair setting member 21 toward the knob 24.

In consequence, the hair wound round the hair setting member 21 is heated from both inner and outer sides. Since the heating of hair is made sinultaneously from both of the inner and outer sides, the hair is curled evenly in the shorter period of time. Therefore, the tendency of local heating of the hair is very much suppressed as compared with the conventional hair dryers, so that the damage of the hair is avoided remarkably. In addition, the inner side of the curl is finished without disturbance of hair, because the heating from the inner side is made not by hot air stream but by a conduction of heat. If the change-over switch 7 is operated to switch the heating circuit switch 7A and the motor circuit switch 7B to positions $S'_2$ and $S_2$, respectively, the hair is cooled because only the fan motor 35 is energized. By applying a cold air to the immediately after the cooling, without loosening the hair from the hair setting member 21, it is possible to obtain a stronger setting of the hair and, hence, a longer life of the curl.

When the hair dryer is not used, the change- over switch 7 is so switched as to place the heating circuit switch 7A and the fan motor circuit switch 7B at positions $S'_1$ and $S_1$, respectively.

The temperature of the hot air is gradually lowered toward the end of the hair setting member 21. Therefore, it is difficult to obtain a uniform curling over the entire length of the hair setting member 21.

To avoid the non-uniform curling along the length of the hair setting member 21, the heat generating body 19 is offset forwardly from the center of the heating bar by a distance l, as mentioned before.

Figure 4:
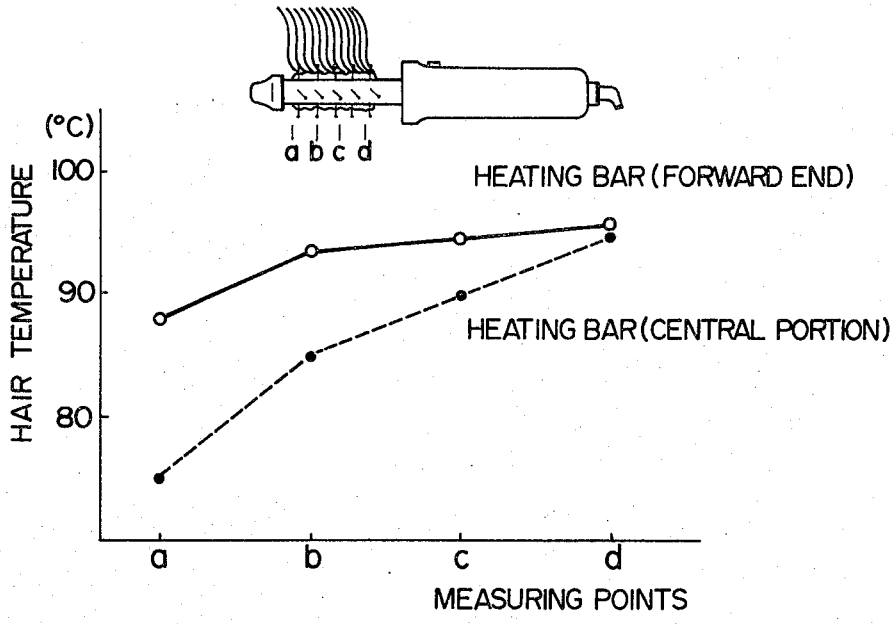
FIG. 4 shows the temperature distribution of hair in the use of the hair dryer.
Figure 5:
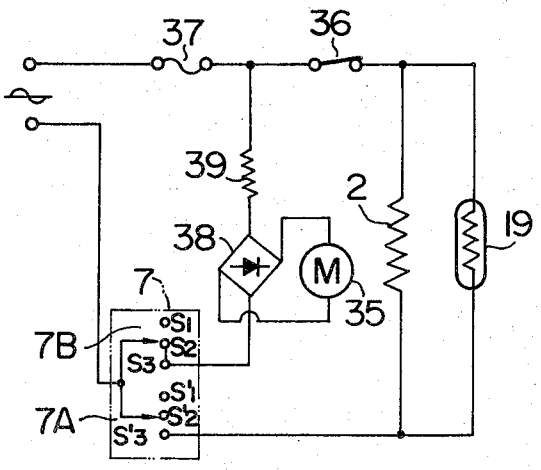
FIG. 5 is a circuit diagram.

More specifically, as shown by broken lines in FIG. 4, the hair is heated to exhibit such a temperature distribution that the hair temperature is drastically lowered along the length of the heating bar toward the end thereof, if the heat generating body 19 is placed at the central portion of the heating bar. However, in the hair dryer of the invention in which the heat generating body 19 is offset forwardly, the hair temperature is lowered toward the end a only gradually, as shown by solid line. Thus, the temperature distribution in the region between the points a and d is much improved as compared with the case of the conventional hair dryer in which the heat generating body 19 is located at the central portion of the heating bar, and it is possible to obtain a substantially uniform curling effect.

Since the heat generating body 19 is constituted by a resistance element having a positive temperature coefficient, it is possible to prevent the excessive heating of hair without necessitating any specific temperature controlling means such as a thermostat. For the same reason, the hair setting member 21 can be heated up in quite a short period of time. Namely, since the resistance element having a positive temperature coefficient permits a large current to flow until a perdetermined temperature is reached, so that the hair setting member 21 is heated in a short time to shorten the time required for the completion of curling of hair. Since in the hair dryer of the invention the hair setting member having the described construction can be replaced with other hair setting members, the prompt heating up of the hair setting member offers a great advantage.

From the foregoing description, it will be seen that the hair dryer of the invention affords a uniform curling of hair with reduced curling time, while avoiding damaging of the hair.

What is claimed is:

1. In a hair dryer having an elongated cylindrical casing, an elongated hair setting member around which the hair is to be wound, said hair setting member being detachably secured to said casing, heating means and blowing means disposed in said casing, an intake port means provided in said casing and a discharge port means for said blowing means provided at a forward end portion of said casing, an improvement comprising an elongated heating bar disposed substantially centrally of said discharge port means and extending forwardly beyond said casing, a heat generating body means associated with said heating bar, said hair setting member being formed of a heat conducting material and including an insertion hole extending in a longitudinal direction of said hair setting member and adapted to receive said heating bar such that contact is established between an outer peripheral surface of said heating bar and an inner peripheral surface of said insertion hole formed in said hair setting member, whereby heat is transferred from said heat generating body means to said hair setting member via said heating bar and a discharge from the blowing means is directed around the hair setting member.

2. A hair dryer as claimed in claim 1 wherein a heat generating body means is disposed within an interior of said heating bar such that a center of the heat generating body means is offset forwardly from a longitudinal center of said heating bar.

3. A hair dryer as claimed in claim 1 wherein said heating bar accommodates a heat generating body constituted by a resistance element having a positive temperature coefficient.

4. A hair dryer as claimed in claim 1 wherein a heating circuit is provided including said heating means in said casing and a heat generating body accommodated by said casing and a motor circuit for said blowing means, and a change-over switch which can close simultaneously both of said heating circuit and said motor circuit or, alternatively, said motor circuit solely.

5. A hair dryer as claimed in claim 1, wherein said hair setting member comprises a tubular base body fashioned of a good heat conducting material and formed therein with support grooves, each of said support grooves have a cross sectional shape such that the support groove is narrower at an outer end of said tubular base body than at an inner end thereof, a plurality of brush pieces, each of said brush pieces having a plurality of hair winding projections and a base portion, the base portion is of substantially the same cross sectional shape as said support groove and is adapted to be received in said support groove, a knob secured to a tip end of said tubular base body to hold a front end of said base portion of each of said brush pieces, and a stopper ring secured to the tubular base body to hold a rear end of said base portion of each of said brush pieces.

6. A dryer as claimed in claim 5, wherein said knob is formed at an outer periphery of a rear end thereof with a tubular projection, the tubular projection is adapted to cover an outer periphery of a front end portion of said tubular base body and an outer periphery of the front end portion of each of said brush pieces.

7. A hair dryer having an elongated cylindrical casing, an elongated hair setting member around which the hair is to be wound, said hair setting member being detachably secured to said casing, heating means and blowing means disposed in said casing, an intake port provided in said casing and a discharging provided in said casing and through which a gas is discharged, an improvement which comprises: an elongated heating bar provided in said discharge port and extending forwardly from said casing, and a deep insertion hole extending in the longitudinal direction of said hair setting member and adapted to receive said heating bar, the outer peripheral surface of said heating bar fitting the inner peripheral surface of said deep insertion hole provided in said hair setting member, said hair setting member has a tubular base having a support groove formed in the outer peripheral surface thereof, said support groove extending continuously and having such a cross-sectional that it is wider at an inlet portion than at an outer portion, said hair dryer further comprising: a brush piece having a plurality of projections for winding hair the brush piece being received at a base portion thereof by said support groove of said hair setting member, a knob attached to the front end side of said tubular base and adapted to be contacted by a front end of said brush piece and a stopper ring secured to a rear portion of said tubular base and adapted to contact a rear end of said brush piece.

8. A hair dryer as claimed in claim 7 wherein said base portion of said brush piece in substantially cylindrical and has an outside diameter such that the outer peripheral surface of said brush piece is flush with the outer peripheral surface of said tubular base, and said knob is provided at its rear surface with a tubular projection adapted to overlap the outer periphery of the front portion of said tubular base.

* * * * *